US006919670B2

(12) United States Patent
Kawanami et al.

(10) Patent No.: US 6,919,670 B2
(45) Date of Patent: Jul. 19, 2005

(54) RIB STRUCTURE FOR DISPLAY DEVICE AND ITS MANUFACTURE PROCESS

(75) Inventors: Yoshimi Kawanami, Kawasaki (JP); Yasuhiko Kunii, Kawasaki (JP); Tadashi Furukawa, Chiba (JP); Akihiro Fujinaga, Kawasaki (JP); Kazunori Ishizuka, Kawasaki (JP); Shoichi Iwanaga, Kawasaki (JP); Fumihiro Namiki, Kawasaki (JP); Ryohei Satoh, Mino (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 14 days.

(21) Appl. No.: 09/989,063

(22) Filed: Nov. 21, 2001

(65) Prior Publication Data

US 2002/0190650 A1 Dec. 19, 2002

(30) Foreign Application Priority Data

May 31, 2001 (JP) ..... 2001-164814

(51) Int. Cl.[7] ..... H01J 17/49
(52) U.S. Cl. ..... 313/292; 313/582
(58) Field of Search ..... 313/581–587, 313/580, 292, 238, 609, 610, 495, 496, 497; 315/169.4; 345/60; 445/24, 25

(56) References Cited

U.S. PATENT DOCUMENTS

| | | | | | |
|---|---|---|---|---|---|
| 5,972,528 | A | * | 10/1999 | Kim | 428/697 |
| 6,140,767 | A | * | 10/2000 | Sreeram et al. | 313/582 |
| 6,333,600 | B1 | * | 12/2001 | Mizobata | 313/587 |
| 6,498,431 | B1 | * | 12/2002 | Katayama et al. | 313/582 |
| 2001/0054871 | A1 | * | 12/2001 | Tadaki et al. | 313/586 |

FOREIGN PATENT DOCUMENTS

| | | |
|---|---|---|
| EP | 0712148 A2 | 5/1996 |
| EP | 1077465 A1 | 2/2001 |
| FR | 2797991 | 3/2001 |
| JP | HEI 7-85797 | 3/1995 |
| JP | HEI 8-167380 | 6/1996 |
| JP | HEI 8-329843 | 12/1996 |
| JP | 2000-113825 | 4/2000 |

* cited by examiner

*Primary Examiner*—Karabi Guharay
(74) *Attorney, Agent, or Firm*—Staas & Halsey LLP

(57) ABSTRACT

A rib structure for a display device includes a light-transmissive rib structure containing therein a material absorbent of visible light so that a visible light absorption distance is 40 to 1200 μm (the visible light absorption distance L (μm) means a distance such that visible light decreases to exp(−T/L) times less in connection to the travel distance T (μm), that is, visible light is absorbed by 1-exp (−T/L)).

27 Claims, 5 Drawing Sheets

RIB STRUCTURE FOR DISPLAY DEVICE AND ITS MANUFACTURE PROCESS

CROSS-REFERENCE TO RELATED APPLICATION

This application is related to Japanese Patent Application No. 2001-164814 filed on May 31, 2001, whose priority is claimed under 35 USC § 119, the disclosure of which is incorporated by reference in its entirety.

BACKGROUND OF THE INVENTION

1. Field of the Invention

The present invention relates to a rib structure for a display device and its manufacture process. More particularly, its relates to a rib structure for a display device which realizes display with high brightness and high contrast and which can be easily produced, and its manufacture process.

2. Description of Related Art

Various display devices have been reported, including plasma display panels (PDPs) which are enthusiastically researched as promising large-screen display devices. With the PDPs, it is desired that the brightness and contrast should be improved.

In order to improve the brightness and contrast, a number of techniques have been reported which have been created by paying attention to materials for partitioning discharge spaces of the PDPs.

For example, Japanese Unexamined Patent Publication No. HEI 7(1995)-85797 discloses ribs formed of a light-transmissive material. Japanese Unexamined Patent Publication No. 2000-113825 discloses ribs which are transparent or white within RGB light-emitting units and black between the light-emitting units. These ribs improve an apparent aperture ratio and viewing angle and reduce halation, which results in an improved contrast and brightness.

Further, Japanese Unexamined Patent Publication No. HEI 8(1996)-167380 discloses a rib with a white lower layer and a black upper layer. Japanese Unexamined Patent Publication No. HEI 8(1996)-329843 discloses first ribs, second ribs perpendicular to the first ribs and third ribs in parallel to the first ribs, the first and second ribs absorbing light and the third ribs reflecting light. It is described that the above-mentioned constructions improve the contrast and brightness.

However, the improvements mentioned in the above publications are not sufficient, and further improvement in the contrast and the brightness is desired.

SUMMARY OF THE INVENTION

The inventors of the present invention, after intensive study, have found that the optimization of materials for rib structures can enable the contrast and brightness to be further improved and accomplished the present invention.

The present invention provides a rib structure for a display device comprising light-transmissive rib structures containing therein a material absorbent of visible light so that a visible light absorption distance is 40 to 1200 $\mu$m.

The present invention also provides a rib structure for a display device comprising light-transmissive rib structures containing therein a material absorbent of visible light and having a larger $(\text{brightness})^2/(\text{diffuse reflectance})$ than rib structures not containing the material absorbent of visible light.

The present invention further provides a rib structure for a display device comprising a sintered glass material containing 0.01 to 0.3 wt % of a pigment which contains a metal oxide as a major component.

Still further, the present invention provides a rib structure for a display device comprising a sintered glass material containing 0.03 to 1 wt % of metal fine particles having an average particle diameter of 3 $\mu$m or less.

Further, the present invention provides a rib structure for a display device comprising a sintered glass material containing 0.02X to 0.7X wt % of metal fine particles having an average particle diameter of X $\mu$m.

Furthermore, the present invention provides a process of manufacturing a rib structure for a display device comprising the steps of cutting a layer which is formed of a light-transmissive rib structure material containing a material absorbent of visible light on a substrate, with use of a cutting material containing the same kind of material as that of the material absorbent of visible light, thereby forming a rib structure, and separating a specific amount of the material absorbent of visible light from shavings produced in the cutting step and recycling the separated shavings for the rib structure material.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1A:
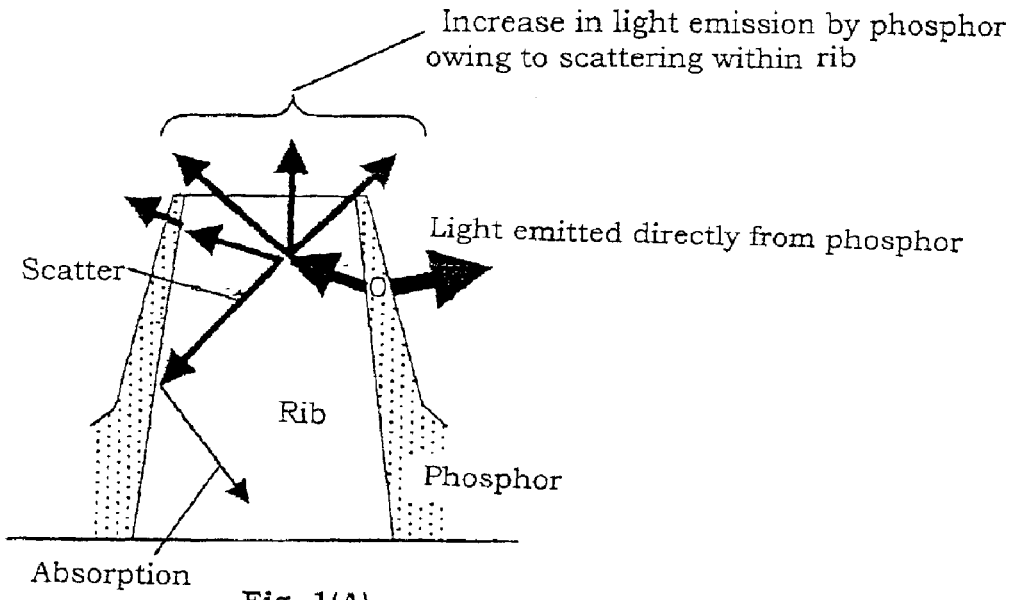
FIGS. 1(A) and 1(B) are a schematic view illustrating the principle of the present invention.
Figure 1B:
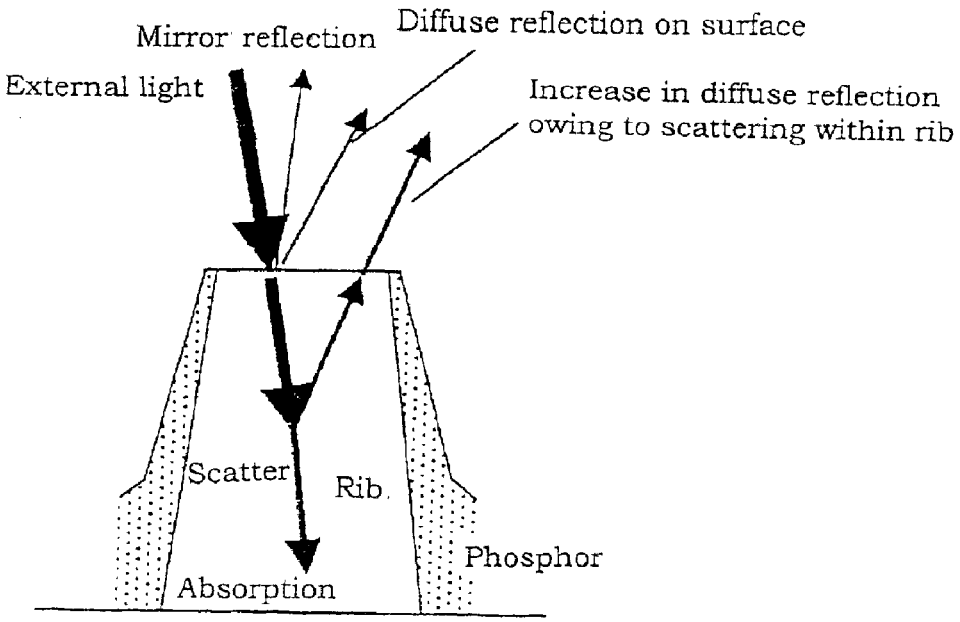

First, the principle of the present invention is explained with reference to FIGS. 1(A) and 1(B). FIG. 1(A) illustrates how the light emitted from a phosphor layer travels within a rib structure, and FIG. 1(B) illustrates how the external light travels within the rib structure. In FIG. 1(A), of the light emitted from a rear face of the phosphor layer and scattered within the rib structure, only a component passing through a short path avoids absorption and goes out of the top of the rib structure. This component contributes to improvement of the brightness. In FIG. 1(B), as regards the external light incident into the rib structure, the less is scattered within the rib structure, the longer path the light passes and the more the light is absorbed, and therefore, its reflection by diffusion within the rib structure can be reduced. The reduction of reflection can improve the contrast.

Referring to FIGS. 1(A) and 1(B), a route by which the external light entering the rib structure is scattered and goes out of the rib structure is longer at least by the length of a return route than a route by which the light emitted from the phosphor layer goes out of the rib structure. The absorption of visible light increases exponentially as the travel distance of light increases. Accordingly, if appropriate absorption of visible light takes place within the rib structure, the reflection of the external light can be sufficiently attenuated while the light emitted from the phosphor layer is attenuated only a little. However, if visible light is absorbed too much, the light emitted from the phosphor layer is also attenuated much, which in turn declines the contrast. Therefore, the absorption of visible light needs to be set within a proper range.

The present invention defines the proper range as follows:

(1) The rib structure contains a material absorbent of visible light so that the visible light absorption distance is 40 to 1200 $\mu$m.

(2) The rib structure contains a material absorbent of visible light and has a larger $(\text{brightness})^2/(\text{diffuse reflectance})$ than a rib structure which does not contain the material absorbent of visible light.

(3) The rib structure is formed of a sintered glass material which contains 0.01 to 0.3 wt % of a pigment containing a metal oxide as a main component.

(4) The rib structure is formed of a sintered glass material which contains 0.03 to 1 wt % of metal fine particles with an average particle diameter of 3 $\mu$m or less.

(5) The rib structure is formed of a sintered glass material which contains 0.02X to 0.7X wt % of metal fine particles with an average particle diameter of X $\mu$m.

First, in definition (1), the visible light absorption distance L ($\mu$m) means a distance such that visible light decreases to exp(−T/L) times less in connection to the travel distance T ($\mu$m), that is, visible light is absorbed by 1-exp(−T/L). If the visible light absorption distance is shorter than 40 $\mu$m, the material may be unstable in uniformity. If the visible light absorption distance exceeds 1200 $\mu$m, the rib structure may lose its effect in improving the brightness. More preferably, the visible light absorption distance is 120 to 400 $\mu$m.

The materials absorbent of visible light are not particularly limited so long as they have the capability of realizing the above-described visible light absorption distance. For example, may be mentioned a pigment containing a metal oxide as a major component, metal fine particles and the like. More particularly, the pigments may be those containing CuO, $Cr_2O_3$, $Fe_2O_3$ and the like, and the metal fine particles may be stainless steel particles, nickel particles, iron particles and the like. These materials absorbent of visible light are added to a rib structure formation material in such an amount that the above-described visible light absorption distance can be realized. The addition amount may be set as appropriate depending upon the kind of a material absorbent of visible light and a rib structure formation material used.

As the rib structure formation material, any known material may be used without particular limitation. For example, may be mentioned materials containing zinc monooxide, diboron trioxide, silicon dioxide, calcium oxide, alumina, titania, zirconia and the like.

Further, the materials absorbent of visible light are not limited to the above-mentioned materials, and the materials comprising the rib structures formed of plastic coated with a transparent protective film may also be used so long as the above-described visible light absorption distance can be realized.

If the rib structure does not contain the above-described material absorbent of visible light, the rib structure preferably has a diffuse transmissivity of 50% or less. If the rib structure has a diffuse transmissivity of 50% or less, i.e., if the rib structure has a scattering ratio of 50% or more, the rib structure allows both the brightness and the contrast to be improved. The diffuse transmissivity is more preferably within the range of 10 to 50%, particularly preferably within the range of 20 to 40%.

Next, in definition (2), the rib structure contains a material absorbent of visible light and has a larger $(\text{brightness})^2/(\text{diffuse reflectance})$ than a rib structure which does not contain the material absorbent of visible light. Here, the $(\text{brightness})^2/(\text{diffuse reflectance})$ is referred to as a contrast coefficient. The contrast coefficient indicates the brightness if the contrast is rendered constant by setting a filter on the display device, and indicates the contrast if the black brightness (the reflection amount of external light) is rendered constant. The brightness and/or the contrast can be improved by setting the contrast coefficient larger than that in the case where the material absorbent of visible light is not contained. The contrast coefficient is preferably 1% or larger, more preferably 5% or larger.

The materials absorbent of visible light are not particularly limited so long as they can give the above-described contrast coefficient to the rib structure. For example, may be mentioned a pigment containing a metal oxide as a major component, metal fine particles and the like. More particularly, the pigments may be those containing CuO, $Cr_2O_3$, $Fe_2O_3$ and the like, and the metal fine particles may be stainless steel particles, nickel particles, iron particles and the like. These materials absorbent of visible light are added to a rib structure formation material in such an amount that the above-described contrast coefficient can be realized. The addition amount may be set as appropriate depending upon the kind of a material absorbent of visible light and a rib structure formation material used.

As the rib structure formation material, the materials mentioned in the above (1) are usable.

Further, the materials absorbent of visible light are not limited to the above-mentioned materials, and the materials comprising the rib structure formed of plastic coated with a transparent protective film may also be used so long as the above-described contrast coefficient can be realized.

In definition (3), the rib structure is formed of a sintered glass material and the sintered glass material contains 0.01 to 0.3 wt % of a pigment containing a metal oxide as a major component. As the sintered glass material, any known material can be used without any particular limitation. For example, may be mentioned materials containing zinc monooxide, diboron trioxide, silicon dioxide, calcium oxide, alumina, titania, zirconia and the like.

As the metal oxide, CuO, $Cr_2O_3$, $Fe_2O_3$ or the like may be mentioned. That the pigment contains the metal oxide as the major component means that the pigment contains 50 wt % of the metal oxide.

If the addition amount of the pigment is less than 0.01 wt %, the uniformity of the material may be unstable, and if it is more than 0.3 wt %, the rib structure may lose its effect in improving the brightness. The addition amount is preferably 0.02 to 0.14 wt %.

Preferably, the pigment has an average particle diameter of 0.5 to 2 μm, though the preferable average particle diameter may vary depending upon the kind of the pigment.

In definition (4), the rib structure is formed of a sintered glass material and the sintered glass material contains 0.03 to 1 wt % of metal fine particles with an average particle diameter of 3 μm or less. As sintered glass materials, the materials mentioned in the above (3) are usable.

The metal fine particles may be stainless steel particles, nickel particles, iron particles and the like. If the addition amount of the metal fine particles is less than 0.03 wt %, the uniformity of the material may be unstable, and if it is more than 1 wt %, the rib structure may lose its effect in improving the brightness. The addition amount is preferably 0.5 to 1 wt %.

In the case where the metal fine particles have an average particle diameter larger than 3 μm, the above description does not apply. This case is separately defined in the below (5).

In definition (5), the rib structure is formed of a sintered glass material, and the sintered glass material contains 0.02X to 0.7X wt % of metal fine particles with an average particle diameter of X μm. As sintered glass materials, the materials mentioned in the above (3) are usable.

The metal fine particles may be stainless steel particles, nickel particles, iron particles and the like. If the addition amount of the metal fine particles is less than 0.02X wt %, the uniformity of the material may be unstable, and if it is more than 0.7X wt %, the rib structure may lose its effect in improving the brightness. The addition amount is preferably 0.04X to 0.3X wt %.

Further, the metal fine particles preferably have an average particle diameter X of 3 to 15 μm.

For producing the rib structure, any known method may be used without any particular limitation. For example, may be mentioned a method of applying a paste of the rib structure formation material and a binder onto a substrate, the rib structure-forming material containing the material absorbent of visible light, the pigment and/or the metal fine particles, cutting by sandblasting, and then followed by baking. The substrate here includes a substrate on which components such as a dielectric layer, electrodes and the like are formed beforehand. If a photosensitive resin is used as a binder, the rib structures may also be formed by exposing and developing the applied paste with use of a mask of desired configuration, followed by baking.

If a cutting material used for sandblasting contains the same kind of metal fine particles (e.g., nickel fine particles) as contained in the rib structure, a predetermined amount of the metal fine particles can be separated from shavings produced, and the shavings can be recycled as a glass material for rib structure formation. This recycle can reduce the cost of raw materials. If the metal fine particles are magnetized, a magnet can be used for separating the metal fine particles from the shavings more easily.

In the present invention, the display device may be a PDP, a field emission display (FED) or the like.

An example is now described which utilizes the present invention for a PDP.

Figure 2:
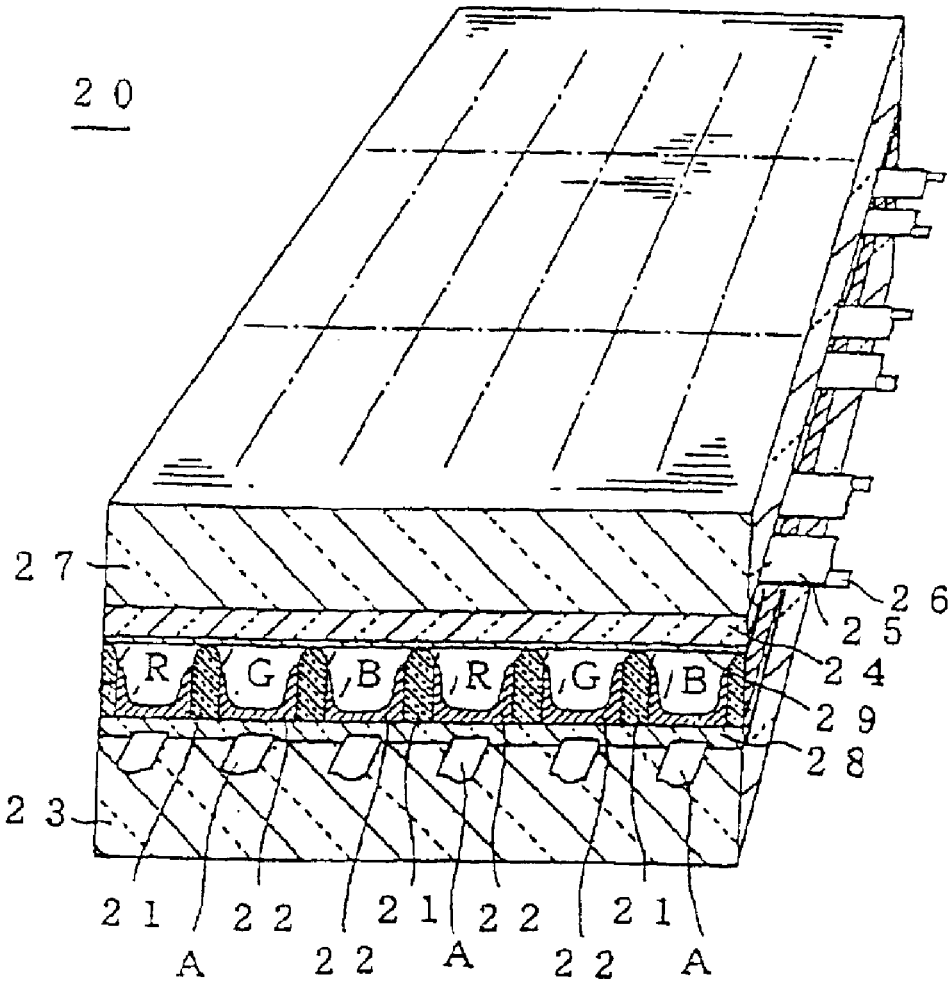
FIG. 2 is a schematic perspective view illustrating the construction of a PDP.

The PDP shown in FIG. 2 is a AC-driven there-electrode surface-discharge PDP. However, the present invention is also applicable to other types of PDPs than this PDP. For example, the invention can be used with not only AC-driven PDPs but also DC-driven PDPs and with both reflection-type PDPs and transmission-type PDPs.

The PDP 20 shown in FIG. 2 is composed of a front substrate and a rear substrate.

The front substrate typically includes a plurality of display electrodes in stripes formed on a substrate 27, a dielectric layer 24 formed to cover the display electrodes and a protective layer 29 formed on the dielectric layer 24 and exposed to the discharge space.

The substrate 27 may be a glass substrate, a quartz glass substrate, a silicon substrate or the like, without particular limitation.

The display electrodes are comprised of transparent electrodes 25 such as of ITO films. Also, in order to reduce the resistance of the display electrodes, bus electrodes 26 (formed of a three-layer structure of Cr/Cu/Cr, for example) may be formed on the transparent electrodes 25.

The dielectric layer 24 is formed of a material usually used for PDPs. More particularly, the dielectric layer 24 may be formed by applying a paste composed of a low-melting glass and a binder onto the substrate, followed by baking.

The protective layer 29 is provided for protecting the dielectric layer 24 from damage which may be caused by impact of ions generated when a discharge for display takes place. The protective layer 29 may be formed of MgO, CaO, SrO, BaO or the like, for example.

The rear substrate typically includes a plurality of address electrodes A formed in stripes on a substrate 23, a dielectric layer 28 covering the address electrodes A, a plurality of rib structures 21 formed in stripes on the dielectric layer 28 between adjacent address electrodes A and phosphor layers 22 formed between the rib structures 21 to extend onto the walls of the rib structures.

As the substrate 23 and the dielectric layer 28, may be used the same types of substrate and layer as the substrate 27 and the dielectric layer 24 of the front substrate.

The address electrodes A are formed, for example, of metal layers of Al, Cr, Cu or the like, or of a three-layer structure of Cr/Cu/Cr.

As the rib structures 21, the previously described rib structures are used.

The phosphor layers 22 may be formed by applying a paste between the rib structures 21 and then baking the paste in an inert atmosphere. In the paste, a particle-form phosphor is dispersed in a solution of a binder in a solvent.

EXAMPLE

The present invention is now described in further detail by way of examples, but the invention is not limited to these examples.

Example 1

The rib structures are formed in the following process using, as the material absorbent of visible light, a black pigment of 1 μm average particle diameter containing CuO and $Cr_2O_3$as major components (contained in about 90 wt %).

More particularly, a layer of a rib structure material is formed by applying onto a substrate (a front substrate) a paste composed of a base glass having the composition shown in Table 1, a filler of alumina ($Al_2O_3$) of 1.5 μm average particle diameter (packing ratio of 18 wt %), the above-mentioned black pigment, a resinous binder and a solvent, followed by drying. A patterned dry resist film is laid on the resulting rib structure material layer, which is then cut by sandblasting with use of the resist film. Thus the rib structure material layer is formed into a desired configuration. Subsequently, the rib structure material layer is baked (sintered by evaporating off the resin component by heating) to obtain the rib structures.

TABLE 1

| Component | Proportion (wt %) |
|---|---|
| PbO | 50–60 |
| $B_2O_3$ | 5–10 |
| $SiO_2$ | 10–20 |
| $Al_2O_3$ | 15–25 |
| CaO | –5 |

Other settings than mentioned above are as follows:

The size of a screen: 42 inches

The number of pixels: 852×480 (VGA)

The number of sub-pixels: 2556×480

The size of the sub-pixels 1080 μm×360 μm

The material of the front substrate: soda-lime glass of 3 mm thickness

The width of the top of the rib structures: 70 μm

The width of the bottom of the rib structures: 140 μm

The height of the rib structures 140 μm

The pitch of the rib structures: 360 μm

The width of the main electrode: 275 μm

The width of a metal film: 100 μm

A surface discharge gap: 100 μm

The thickness of the dielectric layer: 30 μm

The thickness of the protective film: 1 μm or less

When the addition amount of the black pigment is from 0.01 to 0.3 wt %, it is possible to obtain rib structures having a visible light absorption distance of 40 to 1200 μm.

Figure 3:
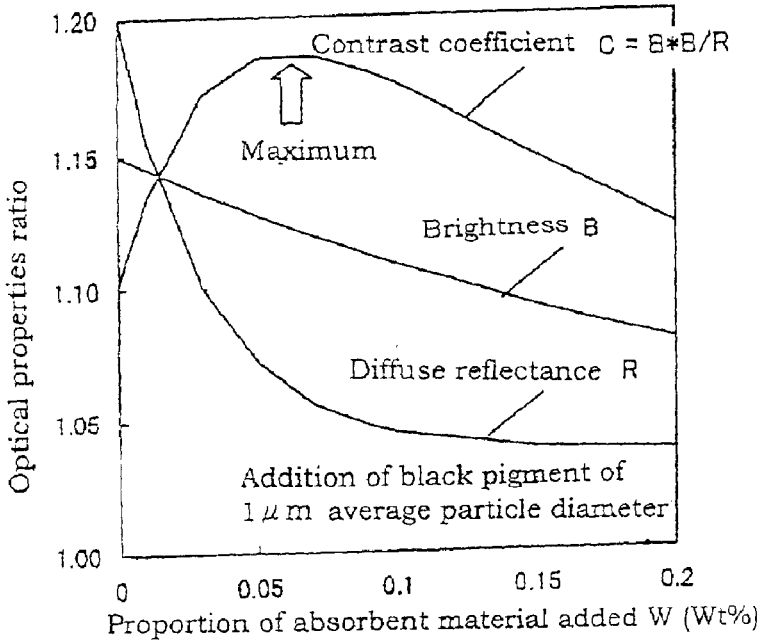
FIG. 3 is a graphical representation showing relationships of the addition amount of a black pigment to the brightness B, diffuse reflectance R and contrast coefficient $B^2/R$ of a PDP.

FIG. 3 is a graphical representation showing relationships of the addition amount of the black pigment to the brightness B, diffuse reflectance R and contrast coefficient $B^2/R$ of the PDP. FIG. 3 shows that the addition of about 0.3 wt % or less of the black pigment increases the contrast coefficient as compared with the case where the black pigment is not added. When the addition amount is about 0.07 wt %, the contrast coefficient is the largest. At the addition amount of about 0.07 wt %, the rib structures are light gray. Here, the contrast coefficient is an index for comparing the brightness of the PDP when the contrast is rendered constant by attaching a filter, and is an index for comparing the contrast and the brightness when the reflection amount of external light (the black brightness) is rendered constant.

Rib structures formed without addition of the above-mentioned black pigment have a diffuse transmissivity of 40% and are white opaque, while the rib structures of this example with addition of the black pigment is of moderate light gray color having a diffuse transmissivity of about 30%. It is not preferable to reduce the scattering of visible light further and raise the diffuse transmissivity to 50% or higher. Of the light emitted in a pixel, part passing the rib structure and escaping toward the rear face of the PDP increases and the brightness declines.

Figure 4:
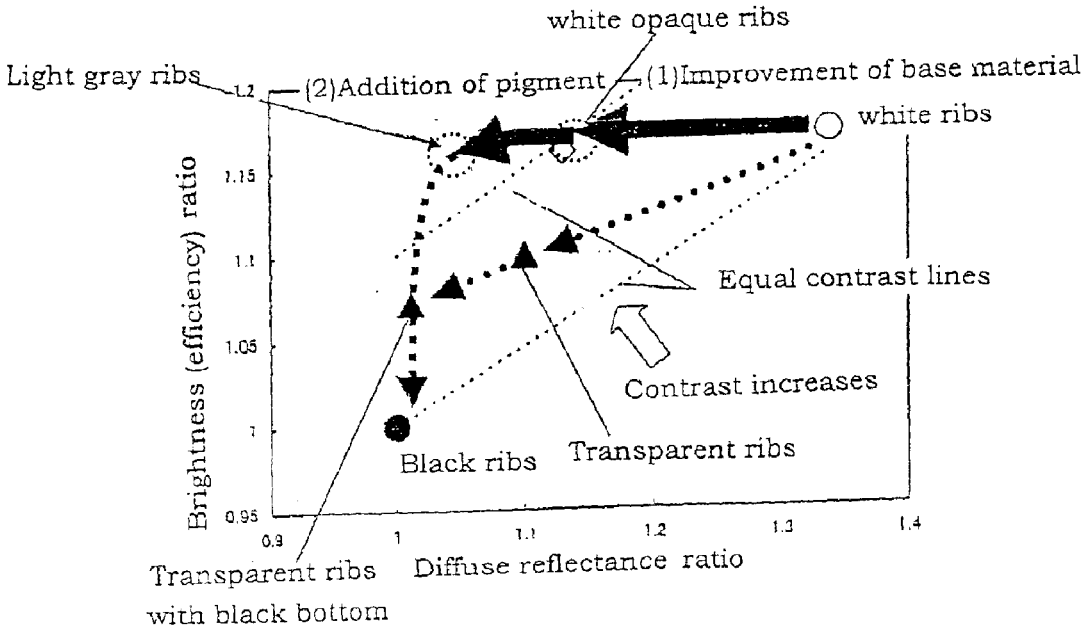
FIG. 4 is a graphical representation showing relationships of the color of rib structures to the brightness, diffuse reflectance and contrast coefficient of a PDP.

FIG. 4 is a graphical representation showing relationships of the color of rib structures to the brightness, diffuse reflectance and contrast coefficient of the PDP. Black rib structures and white rib structures have almost the same contrast coefficients. The base of the rib structures of this example is white opaque and can be rendered light gray by adding the black pigment properly as described above. The light gray rib structures provide the maximum contrast coefficient. FIG. 4 also shows that opaque or transparent rib structures, whose diffuse transmissivity is larger than 50%, have a reduced brightness and a poorer contrast coefficient.

Example 2

A PDP was produced in the same manner as in Example 1 except that stainless steel particles of 9 μm average particle diameter is used instead of the black pigment and alumina of 4.5 μm average particle diameter was used as a filler (packing ratio of 20 wt %). When the addition amount of the stainless steel particles was 0.2 to 6 wt %, it is possible to obtain rib structures having a visible light-absorption distance of 40 to 1200 μm.

Figure 5:
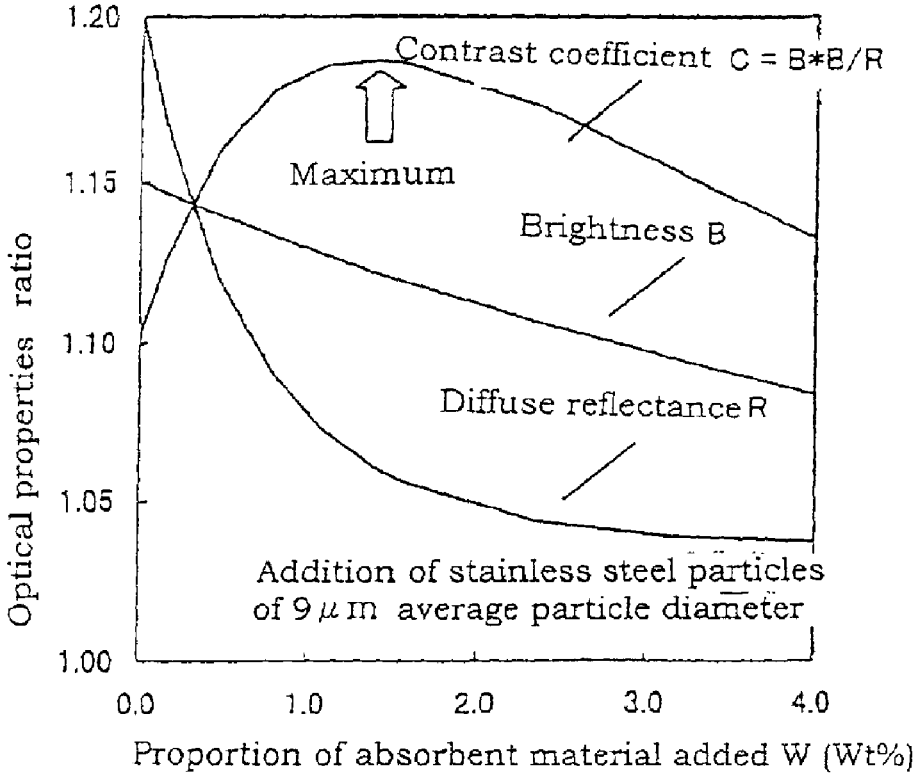
FIG. 5 is a graphical representation showing relationships of the addition amount of stainless steel particles to the brightness B, diffuse reflectance R and contrast coefficient $B^2/R$ of a PDP.

FIG. 5 is a graphical representation showing relationships of the addition amount of stainless steel particles to the brightness B, diffuse reflectance R and contrast coefficient $B^2/R$ of the PDP. FIG. 5 shows that the addition of about 6 wt % or less of the stainless steel particles increases the contrast coefficient as compared with the case where the stainless steel particles are not added. When the addition amount is about 1.4 wt %, the contrast coefficient is the largest.

Example 3

A PDP is produced in the same manner as in Example 1 except that Nickel particles of 0.2 μm average particle diameter was used instead of the black pigment. When the addition amount of the nickel particles is 0.03 to 1 wt %, it is possible to obtain rib structures having a visible light absorption distance of 40 to 1200 μm. When the addition amount is about 0.3 wt %, the contrast coefficient is the largest.

Further, in this example, nickel particles of 9 μm average diameter are used as a cutting material for sandblasting. Shavings produced at cutting are collected and dissolved in a solvent. Nickel particles are partially removed magnetically from the resulting solution and refined. The nickel particles in the shavings have an average particle diameter of 0.2 μm because the particles are ground during cutting and reduced in size. The refined nickel particles are used again for producing the rib structures. On the other hand, the shavings from which the nickel particles have been partially removed may also be used again as the rib structure formation material. At this time, it is necessary to adjust the amount of each component by adding required amounts of the components so that the rib structure formation material contains a constant amount of nickel particles. This recycling can reduce the amount of the rib structure material used and reduce the production costs of PDPs.

Figure 6:
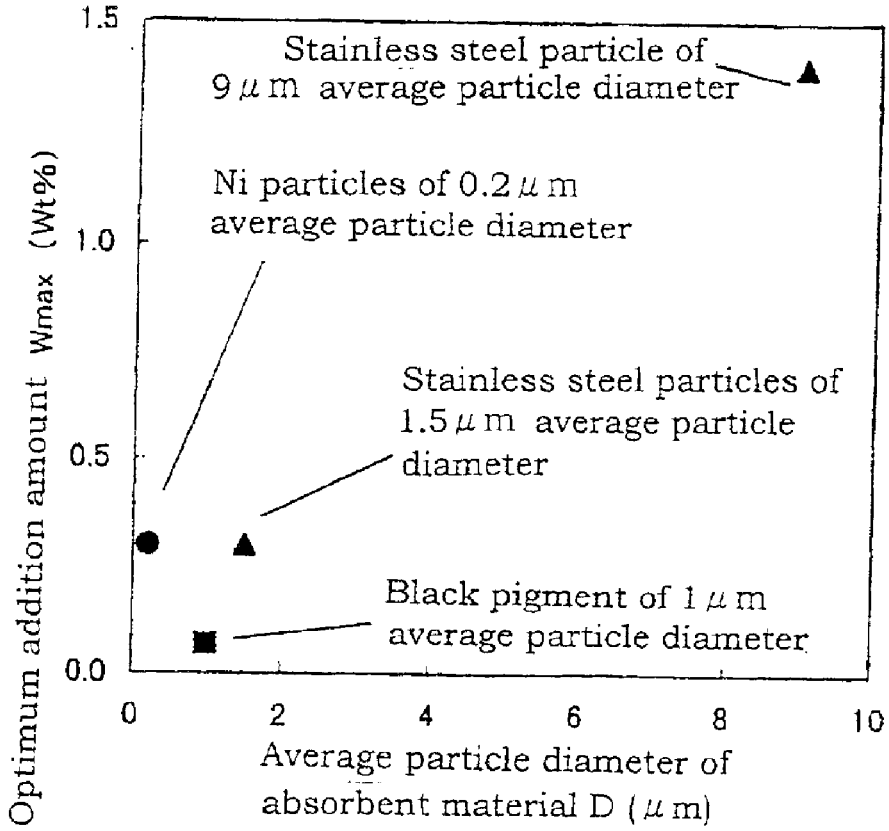
FIG. 6 is a graphical representation showing relationships of the average particle diameter of materials absorbent of visible light to the optimum addition amount Wmax.

FIG. 6 is a graphical representation showing relationships of the average particle diameter of various materials absorbent of visible light to the optimum addition amount Wmax (the addition amount realizing the largest contrast coefficient). Referring to the figure, the optimum addition amount of the pigment having the characteristic of dispersing in the base glass and coloring the glass is relatively small, while the optimum addition amounts of metals are several times as large as that of the pigment. In comparison of stainless steel particles of different particle diameters, the larger the particle diameter is, the larger the optimum addition amount is.

Example 4

A PDP is produced in the same manner as in Example 1 except that the rib structures are formed of a plastic (e.g., epoxy resin) to which the material absorbent of visible light is added so that the visible light absorption distance is 40 to 1200 μm and whose surface is coated with a transparent protective film (e.g., $SiO_2$ film). The PDP of this example also realizes an excellent contrast coefficient.

According to the present invention, it is possible to manufacture display devices with improved brightness and contrast without changing the manufacture process. Also it is possible to reduce the production costs by using, for the cutting material, the same component as contained in the rib structure formation material, collecting the shavings after cutting and recycling them for the rib structure formation material.

What is claimed is:

1. A rib structure for a display device comprising:

a sintered glass material containing 0.01 to 0.3 wt % of a black pigment containing a metal oxide as a major component; and a filler which allows the rib structure to have a diffuse transmissivity of 10% to 50% in the absence of a material absorbent of visible light, wherein the filler contains alumina, a discharge space is partitioned by the rib structure, and a phosphor layer is provided on a side of the rib structure.

2. A rib structure as in claim 1, wherein the black pigment is the material absorbent of visible light so that a visible light absorption distance is 40 to 1200 μm, where (the visible light absorption distance is L μm, the travel distance T μm and visible light is absorbed by 1-exp(−T/L).

3. A plasma display panel having a discharge space partitioned by a rib structure as set forth in claim 2.

4. A rib structure according to claim 2, wherein the filler is $Al_2O_3$.

5. A rib structure as in claim 1, wherein the black pigment is the material absorbent of visible light so that the rib structure has a larger $(\text{brightness})^2/(\text{diffuse reflectance})$ than a rib structure not containing the material absorbent of visible light.

6. A plasma display panel having a discharge space partitioned by a rib structure as set forth in claim 5.

7. A rib structure according to claim 5, wherein the filler is $Al_2O_3$.

8. A plasma display panel having a discharge space partitioned by a rib structure as set forth in claim 1.

9. A rib structure for a display device comprising:

a sintered glass material containing 0.03 to 1 wt % of metal fine particles having an average particle diameter of 3 μm or less, wherein a discharge space is partitioned by the rib structure, a phosphor layer is provided on a side of the rib structure, and the rib structure contains a filler which allows the rib structure to have a diffuse transmissivity of 10% to 50% in the absence of a material absorbent of visible light, the filler containing alumina.

10. A plasma display panel having a discharge space partitioned by a rib structure as set forth in claim 9.

11. A rib structure according to claim 9, wherein the filler is $Al_2O_3$.

12. A rib structure as in claim 9, wherein the metal fine particles are provided in a pigment provided in the sintered glass material, the pigment with the metal fine particles provided therein being the material absorbent of visible light so that a visible light absorption distance is 40 to 1200 μm, where the visible light absorption distance is L μm, the travel distance is T μm, and visible light is absorbed by 1-exp(−T/L).

13. A rib structure as in claim 9, wherein the metal fine particles are provided in a pigment provided in the sintered glass material, the pigment with the metal fine particles provided therein being the material absorbent of visible light so that the rib structure has a larger $(\text{brightness})^2/(\text{diffuse reflectance})$ than a rib structure not containing the material absorbent of visible light.

14. A rib structure for a display device comprising:

a sintered glass material containing 0.02X to 0.7X wt % of metal fine particles having an average particle diameter of X μm, wherein a discharge space is partitioned by the rib structure, a phosphor layer is provided on a side of the rib structure, and the rib structure contains a filler which allows the rib structure to have a diffuse transmissivity of 10% to 50% in the absence of a material absorbent of visible light, the filler containing alumina.

15. A plasma display panel having a discharge space is partitioned by a rib structure as set forth in claim 14.

16. A rib structure according to claim 14, wherein the filler is $Al_2O_3$.

17. A rib structure as in claim 14, wherein the metal fine particles are provided in a pigment provided in the sintered glass material, the pigment with the metal fine particles provided therein being the material absorbent of visible light so that a visible light absorption distance is 40 to 1200 μm, where the visible light absorption distance is L μm, the travel distance is T μm, and visible light is absorbed by 1-exp(−T/L).

18. A rib structure as in claim 14, wherein the metal fine particles are provided in a pigment provided in the sintered glass material, the pigment with the metal fine particles provided therein being the material absorbent of visible light and has a larger $(\text{brightness})^2/(\text{diffuse reflectance})$ than a rib structure not containing the material absorbent of visible light.

19. An apparatus comprising:

a plasma display panel comprising a light-transmissive rib structure partitioning a discharge space of the plasma display panel, the rib structure comprising a filler and a material absorbent of visible light so that a visible light absorption distance is 40 to 1200 μm where visible light absorption distance is L μm, the travel distance is T μm, and visible light is absorbed by 1-exp(−T/L), and a phosphor layer on a side of the rib structure, wherein the filler allows the rib structure to have a diffuse transmissivity of 10% to 50% in the absence of a material absorbent of visible light, the filler containing alumina.

20. An apparatus according to claim 19, wherein the filler is $Al_2O_3$.

21. An apparatus comprising:

a plasma display panel comprising a light-transmissive rib structure partitioning a discharge space of the plasma display panel, the rib structure comprising a filler and a material absorbent of visible light and having a larger $(\text{brightness})^2/(\text{diffuse reflectance})$ than a rib structure not containing the material absorbent of visible light, and a phosphor layer on a side of the rib structure, wherein the filler allows the rib structure to have a diffuse transmissivity of 10% to 50% in the absence of a material absorbent of visible light, the filler containing alumina.

22. An apparatus according to claim 21, wherein the filler is $Al_2O_3$.

23. An apparatus comprising:

a plasma display panel comprising a rib structure partitioning a discharge space of the plasma display panel, the rib structure comprising a sintered glass material containing 0.01 to 0.3 wt % of a black pigment containing a metal oxide as a major component, the rib structure comprising a filler which allows the rib structure to have a diffuse transmissivity of 10% to 50% in the absence of a material absorbent of visible light, the filler containing alumina; and a phosphor layer on a side of the rib structure.

24. An apparatus comprising:

a plasma display panel comprising a rib structure partitioning a discharge space of the plasma display panel, the rib structure comprising a filler and a sintered glass material containing 0.03 to 1 wt % of metal fine particles having an average particle diameter of 3 $\mu$m or less, the filler allowing the rib structure to have a diffuse transmissivity of 10% to 50% in the absence of a material absorbent of visible light, the filler containing alumina; and a phosphor layer on a side of the rib structure.

25. An apparatus according to claim 24, wherein the filler is $Al_2O_3$.

26. An apparatus comprising:

a plasma display panel comprising a rib structure partitioning a discharge space of the plasma display panel, the rib structure comprising a filler and a sintered glass material containing 0.02X to 0.7X wt % of metal fine particles having an average particle diameter of X $\mu$m, the filler allowing the rib structure to have a diffuse transmissivity of 10% to 50% in the absence of a material absorbent of visible light, the filler containing alumina; and a phosphor layer on a side of the rib structure.

27. An apparatus according to claim 26, wherein the filler is $Al_2O_3$.

* * * * *

UNITED STATES PATENT AND TRADEMARK OFFICE

CERTIFICATE OF CORRECTION

PATENT NO. : 6,919,670 B2
DATED : July 19, 2005
INVENTOR(S) : Yoshimi Kawanami et al.

It is certified that error appears in the above-identified patent and that said Letters Patent is hereby corrected as shown below:

Column 9,
Line 27, after "where" delete "(".
Line 28, after "travel distance" insert -- is --, also after "T μm" insert -- , --.

Column 10,
Line 44, after "1200 μm" insert -- , --, also after "where" insert -- the --.

Signed and Sealed this

Twenty-first Day of March, 2006

JON W. DUDAS
*Director of the United States Patent and Trademark Office*